US005261387A

United States Patent [19]

Gressenich

[11] Patent Number: 5,261,387

[45] Date of Patent: Nov. 16, 1993

[54] COOK TOP

[75] Inventor: Klaus Gressenich, Traun, Fed. Rep. of Germany

[73] Assignee: Bosch-Siemens Hausgeraete GmbH, Munich, Fed. Rep. of Germany

[21] Appl. No.: 725,632

[22] Filed: Jul. 3, 1991

[30] Foreign Application Priority Data

Jul. 3, 1990 [DE] Fed. Rep. of Germany ... 9010072[U]

[51] Int. Cl.[5] ..... F24C 3/00

[52] U.S. Cl. ..... 126/39 H; 126/214 R; 126/39 R

[58] Field of Search ..... 126/39 H, 39 J, 39 E, 126/211, 214 R, 214 A, 39 R

[56] References Cited

U.S. PATENT DOCUMENTS

| | | | |
|---|---|---|---|
| 2,870,828 | 1/1959 | Hess | 126/39 J |
| 3,947,652 | 3/1976 | Cobb | 126/39 J |
| 4,083,355 | 4/1978 | Schwank | 126/39 J |

*Primary Examiner*—Larry Jones

*Attorney, Agent, or Firm*—Herbert L. Lerner; Laurence A. Greenberg

[57] ABSTRACT

A cook top includes a flat area for placing kitchenware. The flat area has markings, in the form of lines, dots or the like, identifying heatable cooking areas. The flat area is formed of a plate of glass or glass ceramic material in the vicinity of the markings and remaining glass or glass ceramic material. The markings are formed of the glass or glass ceramic material of the plate. The glass or glass ceramic material of the plate has a different material structure in the vicinity of the markings than the remaining glass or glass ceramic material.

6 Claims, 1 Drawing Sheet

COOK TOP

BACKGROUND OF THE INVENTION

1. Field of the Invention

The invention relates to a cook top with a flat area for placing kitchenware, the area being formed of a plate of glass or glass ceramic material, and the area in particular having markings in the form of lines, dots or the like, in order to identify heatable cooking areas.

2. Description of the Related Art

In glass ceramic cook tops, it is customary to print some decoration on the flat cooking surface, in particular in order to mark out the various heatable cooking areas. A problem which exists is that when dishes or pots with a rough bottom are pushed around on the cook top, the decoration is gradually rubbed off. That disadvantage is largely overcome in accordance with a further proposal disclosed in German Published Petty Patent Application DE-GM 88 01 334.0 by providing indentations in the cooking area of the cook top at points where the decoration is intended to be, and then filling the indentations with some decorative material, such as a decorative ink that can be used in printing.

It is accordingly an object of the invention to provide a cook top, which overcomes the hereinafore-mentioned disadvantages of the heretofore-known devices of this general type and which makes the markings even simpler and indestructible.

SUMMARY OF THE INVENTION

With the foregoing and other objects in view there is provided, in accordance with the invention, a cook top, comprising a flat area for placing kitchenware, the flat area having markings, in the form of lines, dots or the like, identifying heatable cooking areas, the flat area being formed of a plate of glass or glass ceramic material in the vicinity of the markings and remaining glass or glass ceramic material, the markings being formed of the glass or glass ceramic material of the plate, and the glass or glass ceramic material of the plate having a different material structure in the vicinity of the markings than the remaining glass or glass ceramic material.

In accordance with a concomitant feature of the invention, the plate has a surface, the markings are in the form of indentations in the surface of the plate, and the indentations have a surface structure, such as matte, differing from the surface structure of the surface of the plate surrounding the indentations.

It is accordingly seen that these markings can be made in a simple manner by incorporating slight indentations in the surface of the cook top, for instance by laser technology, in such a way that the surface of the indentations has greater roughness, for instance is made matte, than the remaining surface of the cook top. In each case, due to the different structure of the surface, of whatever type, it is assured that because of the difference in optical reflection as compared with the rest of the cook top material, or the difference in optical coefficients of refraction, the markings are clearly recognizable. Material structures that can be easily visually recognized in this way can be provided not only on the surface of the cook top forming the cooking area but also at any other point on the cook top, for instance on the lower surface of the cook top, where they become clearly visible as markings of cooking areas because the heating of the cook top operates in the incandescent temperature range.

Other features which are considered as characteristic for the invention are set forth in the appended claims.

Although the invention is illustrated and described herein as embodied in a cook top, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
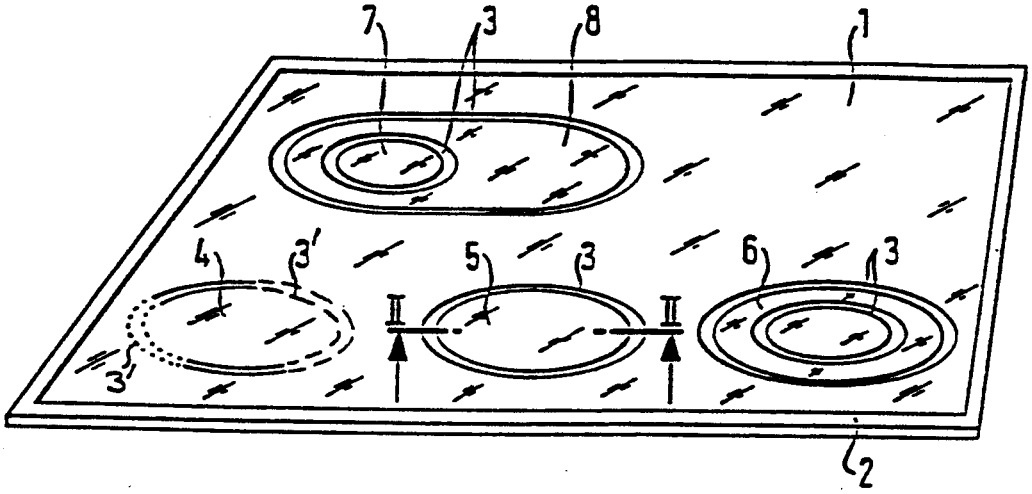
FIG. 1 is a diagrammatic perspective view of an electric cook top.

Referring now to the figures of the drawing in detail and first, particularly, to FIG. 1 thereof, there is seen a cook top which includes a flat area for placing kitchenware, being formed of a plate 1 of vitreous, or in other words glass or glass ceramic, material, enclosed by a frame 2. This kind of cook top can be used in a suitable cutout of a kitchen counter. Underneath the plate 1 are a plurality of non-illustrated electric heaters, such as radiant heaters. In order to mark or identify the corresponding cooking areas directly above these heaters, the plate 1 has markings 3 in the form of circular or oval lines, which outline circular or concentric cooking areas 4, 5, 6, 7 and one oval cooking area 8.

Figure 2:
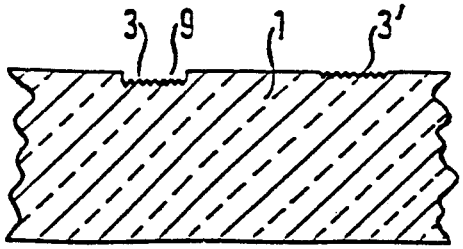
FIG. 2 is an enlarged, fragmentary, longitudinal-sectional view taken along the line II—II of FIG. 1, in the direction of the arrows.

As is particularly shown in the sectional view of FIG. 2, these markings 3 and 3' are formed by material or surface structures in the form of lines, which differ from the material or surface structure of the adjoining material of the plate. It is suggested in FIG. 2 that indentations 9 made in the plate surface have a surface structure of greater roughness than the surface structure of the plate 1 itself. It is sufficient for these indentations 9 to have a depth of only a few hundredths of a millimeter. Optionally, a slight roughening of the plate surface in the form of lines or even dots may suffice, as shown at reference numeral 3' in FIG. 1. This kind of different material or surface structure can be produced in a simple manner by means of laser techniques.

I claim:

1. A cook top, comprising a flat area for placing kitchenware, said flat area being formed of a plate of vitreous material having markings identifying heatable cooking areas, said markings being formed of said vitreous material of said plate, and said vitreous material of said plate having a material structure being different from the material structure of said plate in the vicinity of said markings, wherein said plate has a surface, said markings are in the form of indentations in the surface of said plate, and said indentations have a surface structure differing from the surface structure of the surface of said plate surrounding said indentations.

2. The cook top according to claim 1, wherein said vitreous material is a glass material.

3. The cook top according to claim 1, wherein said vitreous material is a glass ceramic material.

4. The cook top according to claim 1, wherein said markings are in the form of lines.

5. The cook top according to claim 1, wherein said markings are in the form of dots.

6. The cook top according to claim 1, wherein said surface structure of said indentations is matte.

* * * * *